US006010201A

United States Patent [19]

Shimoda

[11] Patent Number: 6,010,201

[45] Date of Patent: Jan. 4, 2000

[54] RECORDING HEAD UTILIZING AN ELECTRICALLY CONDUCTIVE FILM TO DETECT INK REMAINS AND INK JET RECORDING APPARATUS HAVING SAID RECORDING HEAD

[75] Inventor: Junji Shimoda, Chigasaki, Japan

[73] Assignee: Canon Kabushiki Kaisha, Tokyo, Japan

[21] Appl. No.: 08/955,722

[22] Filed: Oct. 22, 1997

Related U.S. Application Data

[63] Continuation of application No. 08/447,006, May 22, 1995, abandoned.

[30] Foreign Application Priority Data

May 27, 1994 [JP] Japan ..... 6-115127
May 9, 1995 [JP] Japan ..... 7-110645

[51] Int. Cl.[7] ..... B41J 2/195

[52] U.S. Cl. ..... 347/7; 347/19

[58] Field of Search ..... 347/5, 7, 19, 85, 347/86; 73/1 H, 290 R, 302; 340/622

[56] References Cited

U.S. PATENT DOCUMENTS 4,782,754 11/1988 Pohlig ..... 347/7
5,070,346 12/1991 Mochizuki et al. ..... 347/7
5,214,450 5/1993 Shimoda ..... 347/10
5,386,224 1/1995 Deur et al. ..... 347/7

FOREIGN PATENT DOCUMENTS 0440110 1/1991 European Pat. Off. .
0615846 9/1994 European Pat. Off. .
4009808 8/1990 Germany .

*Primary Examiner*—N. Le
*Assistant Examiner*—L. Anderson
*Attorney, Agent, or Firm*—Fitzpatrick, Cella, Harper & Scinto

[57] ABSTRACT

A recording head having discharge portions for discharging multiple inks and liquid chambers in communication with said discharge portions, said recording head comprising an electrically conductive film provided tangentially with the ink on a part of a wall constituting said liquid chambers, and an electrical connection for electrically connecting to an ink jet recording apparatus on which said recording head is mounted, wherein said electrically conductive film and said electrically connection are connected to measure the resistance between said electrically conductive film and an electrode located within an ink storage portion.

13 Claims, 6 Drawing Sheets

RECORDING HEAD UTILIZING AN ELECTRICALLY CONDUCTIVE FILM TO DETECT INK REMAINS AND INK JET RECORDING APPARATUS HAVING SAID RECORDING HEAD

This application is a continuation of application Ser. No. 08/447,006, filed May 22, 1995, now abandoned.

BACKGROUND OF THE INVENTION

1. Field of the Invention

The present invention relates to recording means and an apparatus having said recording means, for forming an image by discharging liquid droplets onto the recording medium in accordance with image information, and more particularly to a recording head and an ink jet recording apparatus having said recording head, using heat generating elements as the energy generator in order to discharge liquid droplets.

2. Related Background Art

Conventionally, in the ink jet recording apparatus, the provision of a mechanism for detecting the ink remain within an ink storage portion has been proposed to prevent the ink within the ink storage portion from being completely exhausted on the course of the continuous scanning for recording, resulting in a failure (undischarge) of discharging no ink in accordance with the recording signal.

This ink remain detecting mechanism was typically in the form of reading the resistance value between two electrodes disposed at a fixed interval in an ink tank unit for holding the recording ink as shown in FIG. 1. This mechanism is one which detects whether or not the ink remains within the ink tank, using the variations in resistance value which resulted from the difference in specific resistance between the ink and the air.

In FIG. 1, 11 is an ink tank for holding the ink inside thereof, and 12 is a recording head for discharging the ink. This recording head 12 is internally provided with orifices for discharging recording liquid droplets, heaters which are heat generating elements for forming recording liquid droplets, and a plurality of ink flow passageways for supplying the ink to the regions where these heaters are provided, and is further formed with a common liquid chamber for supplying the ink to the plurality of ink flow passageways.

And 13 is a pair of electrodes for measuring the resistance value for detecting the ink remain within the ink tank 11, as above described. These electrodes are provided on the lower part of the ink storage portion within the ink tank, when mounted on the ink jet recording apparatus.

In the above constitution, the resistance between electrodes 13 becomes lower when there is plenty of ink inside, because the electricity will conduct, that is, the specific resistance of the ink is lower than that of the air, whereas when there is less ink inside than reaching the level where the electrodes are provided, It becomes high. By sensing a change in this resistance value, the detection of whether or not the ink remains can be effected.

However, because the ink within the ink storage portion will oscillate along with the scanning for recording, at least one pair of electrode pins having a certain length must be provided within the ink storage portion to measure the resistance between the electrodes without malfunction, which imposed some restrictions on the shape of the ink storage portion.

Further, it is necessary that they are spaced away a predetermined distance from the wall of the ink storage portion or each other not to enable the electrical conduction due to ink liquid droplets sticking to the electrodes. Therefore, the detection will occur in the condition where there is still ink remain within the ink storage portion, for which an additional process including the pulse count is required to consume this remaining ink.

Also, even if the ink remain is detected to be sufficient, there is a possibility that because of bubbles incidentally arising around the common liquid chamber or ink flow passageways, as previously described, some of the ink flow passageways have been disconnected, wherein the detection of undischarge was not allowed.

SUMMARY OF THE INVENTION

An object of the present invention is to have less ink remain within an ink storage portion upon the ink remain detection, and also detect the invasion of bubbles into ink flow passageways of the recording head.

To achieve the above object, the present invention proposes a construction wherein a recording head having discharge portions for discharging multiple inks and liquid chambers in communication with said discharge portions comprises an electrically conductive film provided tangentially with the ink on a part of a wall constituting said liquid chambers, and an electrical connection for electrically connecting to an ink jet recording apparatus on which said recording head is mounted, wherein said electrically conductive film and said electrical connection are connected to measure the resistance value between said electrically conductive film and the electrodes located within said ink storage portion.

Also, the invention proposes a construction wherein said recording head in the above constitution has further energy generating elements in said discharge portions, and wherein said wall is a substrate on which said energy generating elements are provided.

And the invention further proposes a construction wherein said electrodes are electrically conductive filters disposed at the end of ink flow passageways provided on the recording head side for conducting the ink within said ink storage portion into said recording head. Further, the invention proposes a construction wherein said electrically conductive film is provided on said energy generating elements.

In addition, the present invention proposes a construction wherein an ink jet recording apparatus comprises a recording head having discharge portions for discharging multiple inks and liquid chambers in communication with said discharge portions, and an ink storage portion for storing the ink to be supplied to said recording head, said recording head having an electrically conductive film provided tangentially with the ink on a part of a wall constituting said liquid chambers, and a first electrical connection for receiving a signal involving recording, further comprising a second electrical connection which is connectable to said first electrical connection, the electrodes exposed into the inside of said ink storage portion, and means for measuring the resistance between said electrodes and said conductive film.

By adopting the above-described constructions, the present invention can realize the reliable prediction for undischarge at the lower cost.

DETAILED DESCRIPTION OF THE PREFERRED EMBODIMENTS

The present invention will be described below in detail in connection with the drawings, wherein the parts with like numerals attached have like functions throughout the drawings.

Figure 2:
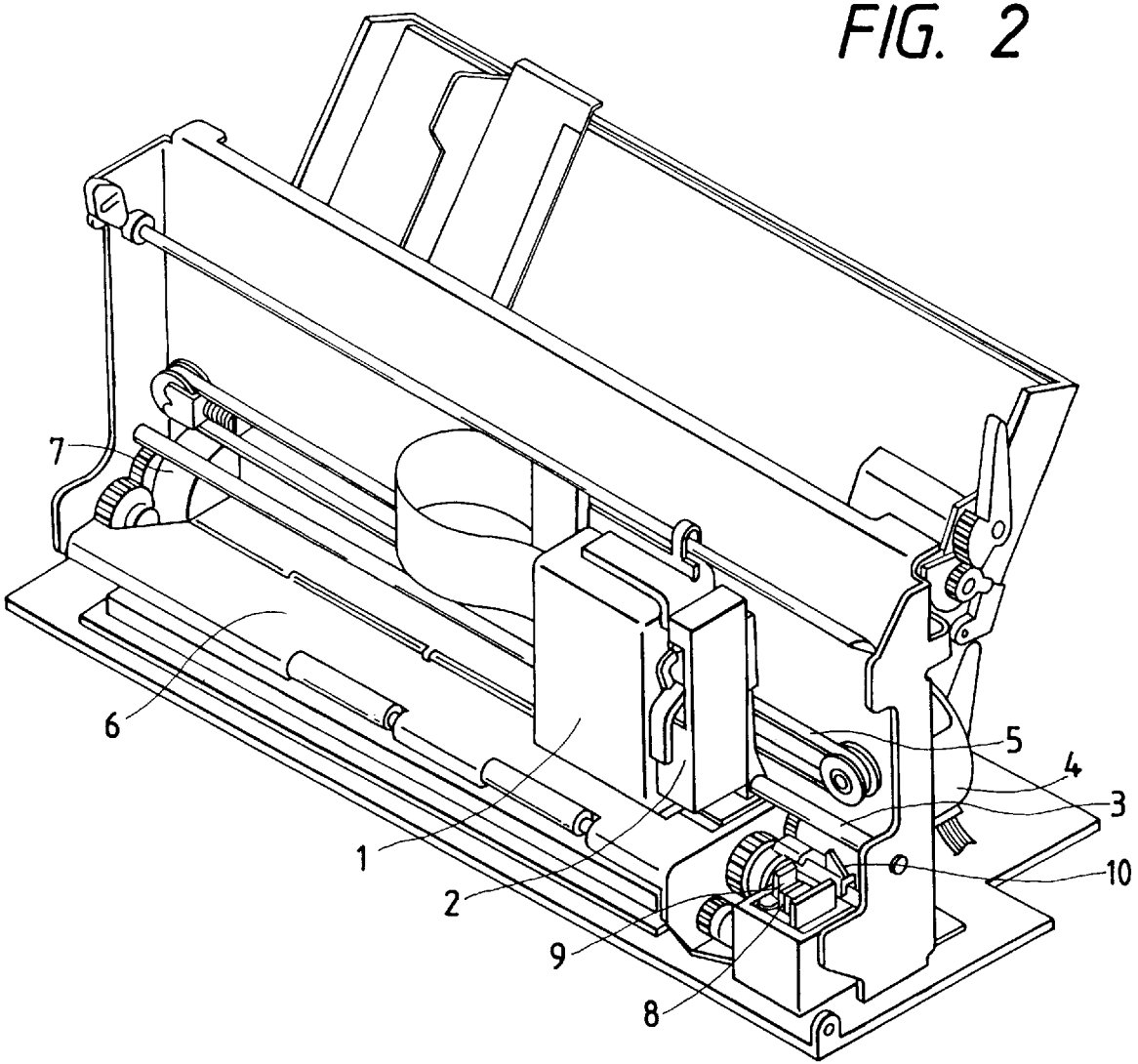
FIG. 2 is a schematic perspective view showing an example of an ink jet recording apparatus to which the present invention is applicable.

FIG. 2 shows an example of an ink jet recording apparatus to which the present invention is applicable. In FIG. 2, 1 is a recording head unit, composed of an ink tank 11 which is an ink storage portion as hereinafter described, and a recording head 12 for discharging the ink.

2 is a carriage on which the recording head unit 1 is mounted detachably, this carriage 2 being scanned along a guide shaft 3 to form an image on the recording medium. Here, the movement of the carriage 2 is performed via a timing belt 5 with the rotation of a carriage motor 4.

And if the recording for one line is completed, the recording medium on a platen 6 is fed a predetermined amount by the driving of a feed motor 7, and the carriage having the recording head unit 1 mounted is scanned again to effect the recording.

Also, a recovery system consisting of a cap 8 and a blade 9 is provided to maintain the recording head unit in excellent discharge condition. Such recovery system fulfills a function of securing close contact with a discharge unit (not shown) of the recording head unit 1 by engagement with a slide bar 10 when the carriage 2 moved to the side of the recovery system.

An ink remain detecting mechanism for use with the ink jet recording apparatus as above described will be now described in detail.

FIRST EXAMPLE

Figure 3:
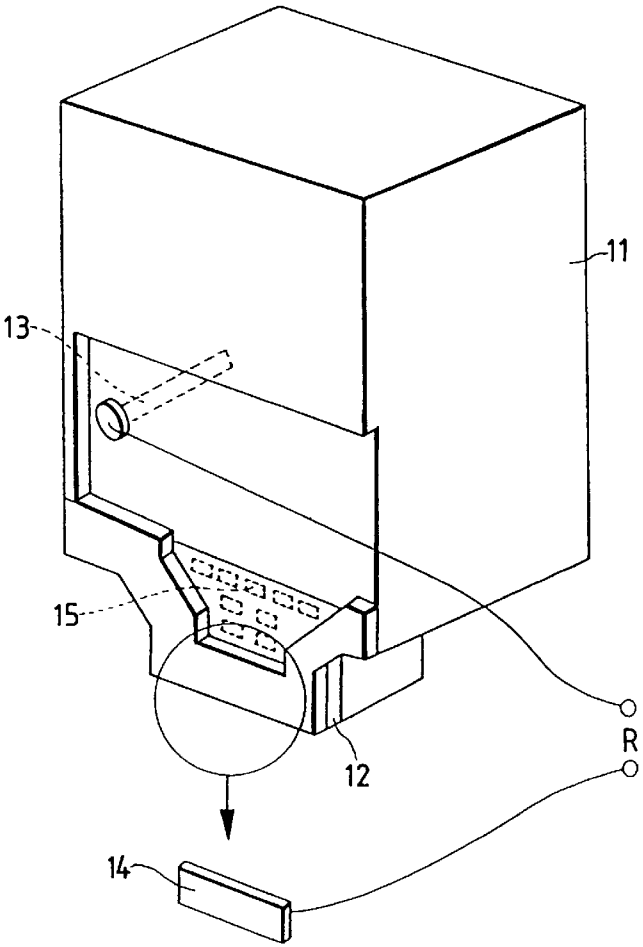
FIG. 3 is a schematic perspective view showing a recording head unit as a first example according to the present invention.
Figure 1:
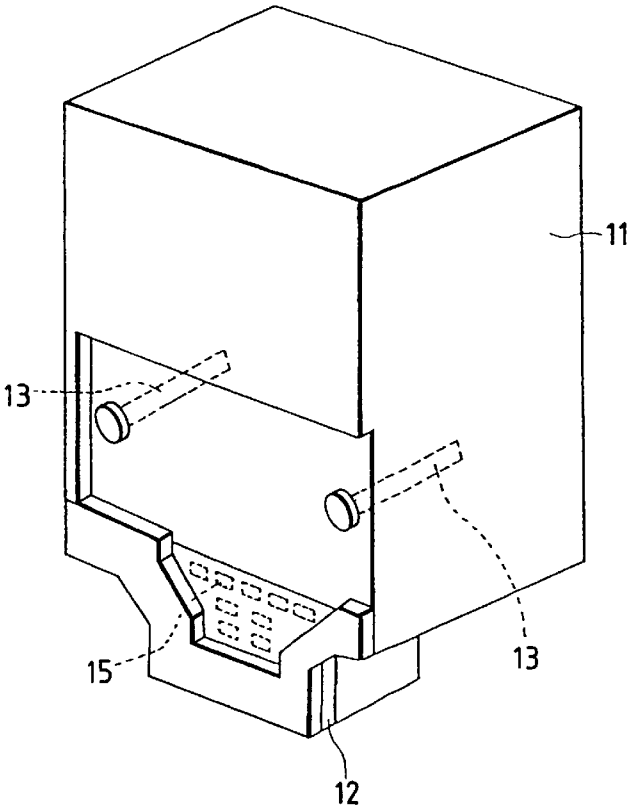
FIG. 1 PRIOR ART
FIG. 1 is a schematic perspective view showing a conventional ink remain detecting mechanism.

FIG. 3 shows a schematic perspective view of the basic form of a recording head unit as a first example of an ink remain detecting mechanism according to the present invention. In FIG. 3, 11 is an ink tank as an ink storage portion for holding the ink inside, and 12 is a recording head as recording means for discharging the ink.

13 is an electrode pin which is one of the electrodes for measuring the resistance value for the detection of ink remain within the ink tank 11, as heretofore described. This electrode pin 13 is provided to make contact with the ink, extending into the lower inside of an ink storage portion within the ink tank, when mounted on the ink jet recording apparatus as previously described.

Inside the recording head 12, there are provided discharge portions comprised of discharge openings (orifices) for discharging recording liquid droplets, and ink flow passageways having energy elements for forming and flying recording liquid droplets through those orifices. In this example, heat generating elements (heaters) as the energy element are used to discharge the ink by utilizing a pressure energy produced upon a change in the ink state.

Further, inside the recording head, a common liquid chamber is formed to supply the ink to the plurality of discharge portions as above mentioned.

14 is a substrate (heater board) on which a plurality of heaters contained within the recording head 12 are formed, wherein an electrically conductive film as will be described later is formed to be tangential with the ink on a part of the surface of this heater board 14 which is tangential with the ink. This heater board 14 serves to construct a wall of the ink flow passageways and the common liquid chamber as previously described.

And 15 is Print Wired Board (hereinafter referred to as PWB) which is an electrical connection with the main body of the recording apparatus, the conductive film formed on the heater board 14 as above mentioned being electrically connected with a specific pad on PWB 15. Thereby, it is possible to measure the resistance value between the electrode pin 13 and the conductive film on the heater board.

Figure 4:
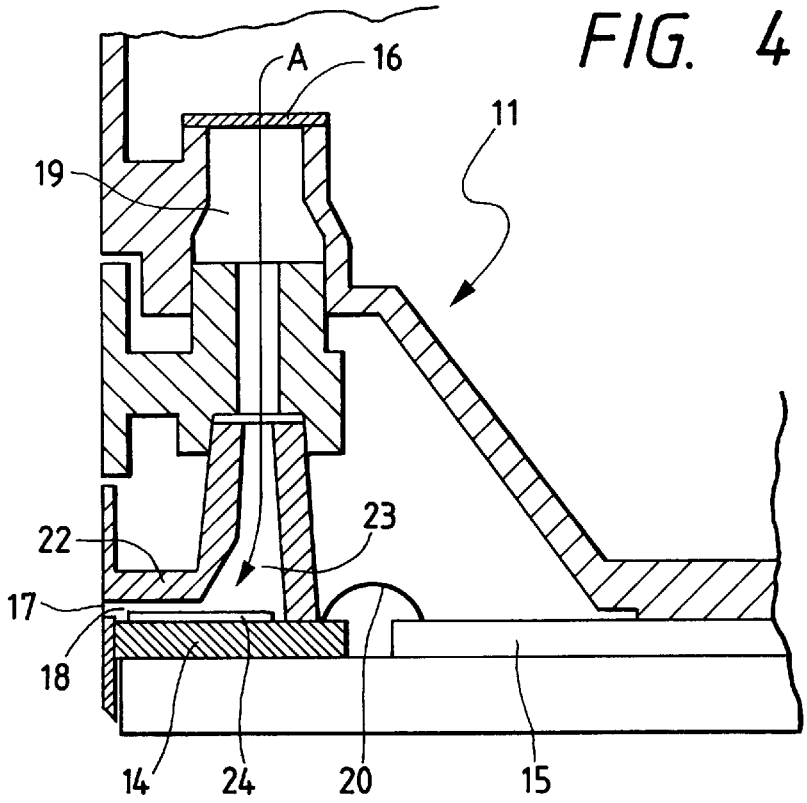
FIG. 4 is an enlarged cross-sectional view of the recording head unit as shown in FIG. 3.

Next, the electrically conductive film for the heater board portion will be described. FIG. 4 is a partial enlarged cross-sectional view of the recording head 12. In FIG. 4, 20 is a wire bonding portion for electrical connection between the heat generating elements provided on the heater board 14 and PWB 15 as previously described. 22 is a ceiling plate for forming a plurality of orifices 17 and ink flow passageways 18 to discharge recording liquid droplets, as well as forming the common liquid chamber 23 commonly in communication with the plurality of ink flow passageways.

And a filter 16 is provided at the end portion on the ink tank side of an ink supply passageway 19 for communicating the inside of the ink tank 11 which is an ink storage portion to the common liquid chamber 23 within the recording head. Herein, an ink channel from the ink tank 11 to the discharge portions formed by the ceiling plate 22 is as shown by the arrow A in the figure, passing through the ink supply passageway 19 and the common liquid chamber 23.

Further, an electrode film 24 as the electrically conductive film is formed on the heater board 14, whereby the electrical resistance via the ink between this electrode film 24 and the electrode pin 13 as previously mentioned is measured.

Figure 5:
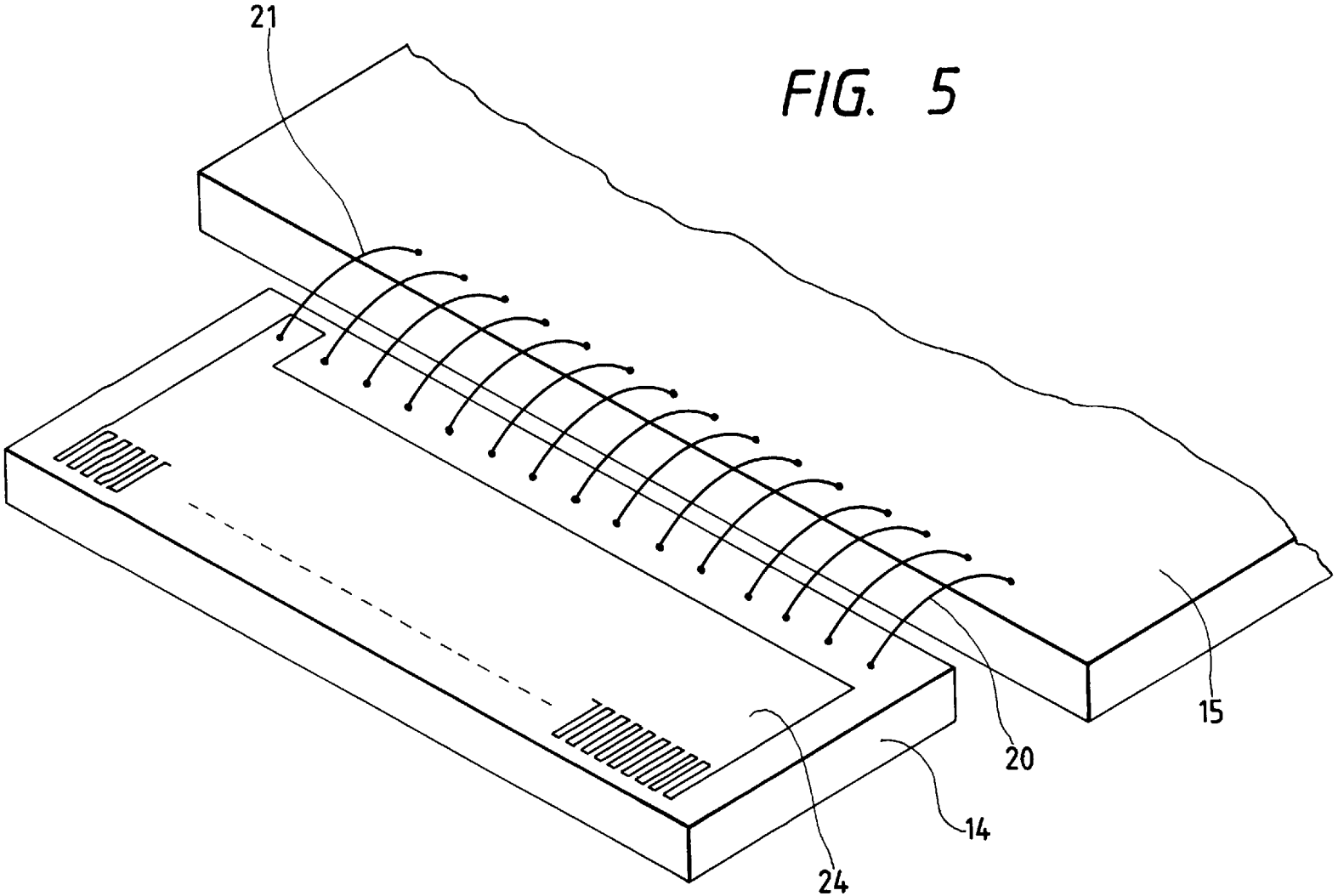
FIG. 5 is a schematic perspective view showing an example of how to provide an electrically conductive film according to the present invention.

FIG. 5 is an enlarged perspective view of the heater board 14 having this electrode film 24. In FIG. 5, 24 is the electrode film, which is formed on the heater board 14 by sputtering or vapor deposition. And 21 is a wire bonding portion for the electrical connection between this electrode film 24 and PWB 15. Accordingly, the detection of resistance value can be made by measurement between the electrode pin 13 and the specific pad of PWB connecting to the wire bonding portion 21.

This electrode film 24 may be provided on the wall forming the common liquid chamber as above mentioned, so as to be tangential with the ink in the state where the recording head is filled with the ink, but in this example, it is extended into the discharge unit to provide this electrode film 24 also on the heaters (heat generating elements) which are energy generators for forming liquid droplets, thereby preventing the breakdown of heat generating elements upon impact (cavitation) encountered when bubbles disappear. That is, it is also made to function as an anti-cavitation film.

To this end, the electrode film 24 is formed on the plurality of heaters in the shape of comb teeth, and in an area tangential with the ink within an ink chamber which is constructed on the heater board 14, as shown in FIG. 5. It should be noted that on a portion without having said comb teeth-shaped electrode film, the wall of the ceiling plate 22 forming the ink flow passageways to discharge the ink is situated.

As in this example, in order that the electrode film 24 has both functions as the ink remain detecting electrode and the anti-cavitation, the material of the electrode film 24 is optimally Ta. However, apart from the anti-cavitation film, when the electrode film 24 is formed, the material used may be those having no chemical change with the ink which is tangential therewith, including, for example, Au or Ag, in addition to Ta.

In the above constitution, the measurement of the resistance value near the common liquid chamber where bubbles are most likely to remain can be made by measuring the resistance value between the electrode 13 and the electrically conductive film within a face tangential with the ink on the heater board 14 via PWB 15. When a sufficient amount of ink resides within this common liquid chamber, the resistance becomes lower because the specific resistance of the ink is lower than the air, or conversely, when there is no ink inside, the resistance becomes high.

Accordingly, by detecting this resistance value and discriminating the difference in the resistance value by measuring means not shown for use with the ink jet recording apparatus, the condition of the ink immediately before its exhaustion, that is, the near-end of the ink, can be sensed, and further, the bubbles arising incidentally near the heater board 14 can be sensed, whereby the prediction for undischarge can be made.

Figure 6:
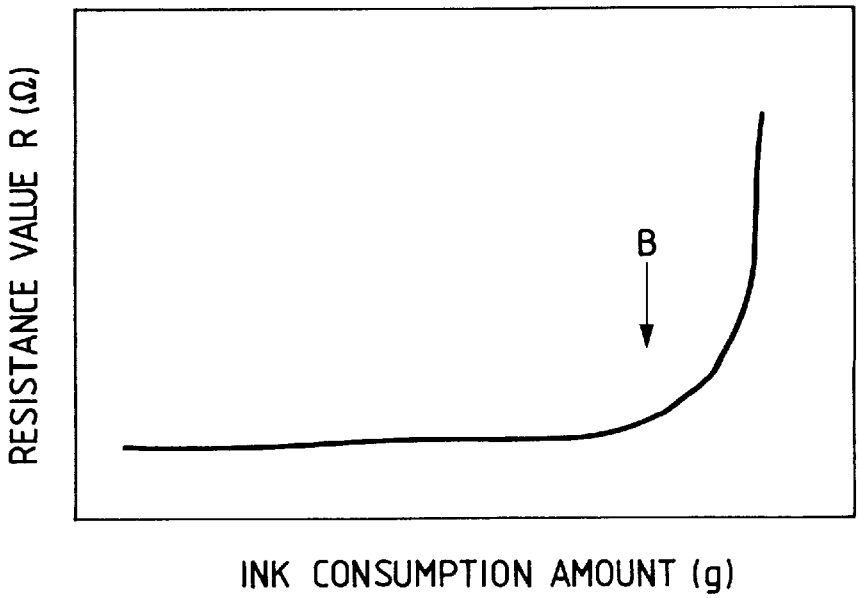
FIG. 6 is a graphical representation showing the relation between the ink consumption amount and the resistance value in the recording head unit of the first example according to the present invention.

The change in resistance value upon invasion of bubbles into the ink flow passageways is shown in FIG. 6. In FIG. 6, the axis of ordinates is a resistance R (in a unit of Ω) between electrodes, and the axis of abscissa is an ink consumption amount (g) within the ink tank. The resistance R between the electrode 13 and the electrically conductive film on the heater board 14 gradually rises with the increase in the ink consumption amount, and immediately before the printing becomes impossible due to the air mixing into the ink supply passageway, the resistance R rapidly rises. Accordingly, by detecting the time as indicated by the arrow B in the figure of exceeding a predetermined resistance, it is possible to predict the undischarge of the ink.

SECOND EXAMPLE

Figure 7:
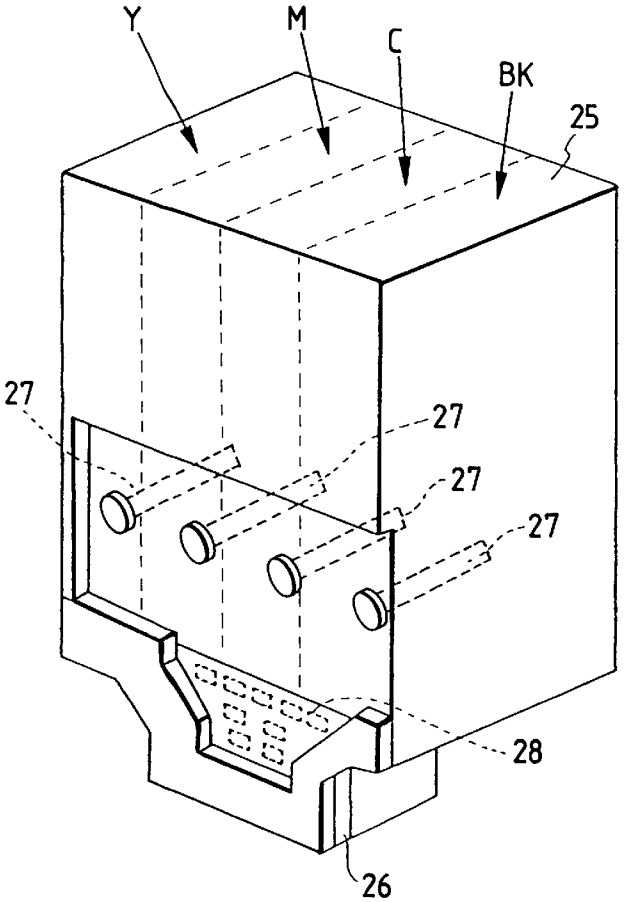
FIG. 7 is a schematic perspective view showing a recording head unit having internally a plurality of ink storage portions for the color recording as a second example according to the present invention.

FIG. 7 shows a second example according to the present invention, and is a schematic perspective view of a recording head unit having ink storage portions and recording means. In FIG. 7, 25 is an ink tank having four ink storage portions to hold four color inks inside, arranged in the order of Y, M, C and Bk color from the left side in the figure. And 26 is a recording head for discharging recording liquid droplets in multiple colors as previously described.

Herein, an ink storage portion for each color within the ink tank 25 is provided with an electrode terminal 27 which is independent from each other. This electrode terminal 27 is one electrode for each color to measure the resistance value for the ink remain detection, in the same manner as in the first example as previously described.

And within the recording head 26, one sheet of electrically conductive film commonly used for each color is formed on the heater board in the like manner as shown in FIG. 5 and previously described, and is electrically connected to one specific pad on the PWB 28.

In the above constitution, by measuring individually the resistance value between one electrically conductive film commonly used for multiple colors and the electrode 27 for each color within the recording head 26 via the PWB 28, the detection for the ink near-end of each color or the ink condition failure within the ink flow passageways can be performed. Also, since one electrically conductive film is commonly used as the electrode for the ink remain detection of each color, the ink near-end can be detected if there is less ink remain for any one of the colors, so that the color representation can be securely effected with a simple constitution.

THIRD EXAMPLE

Figure 8:
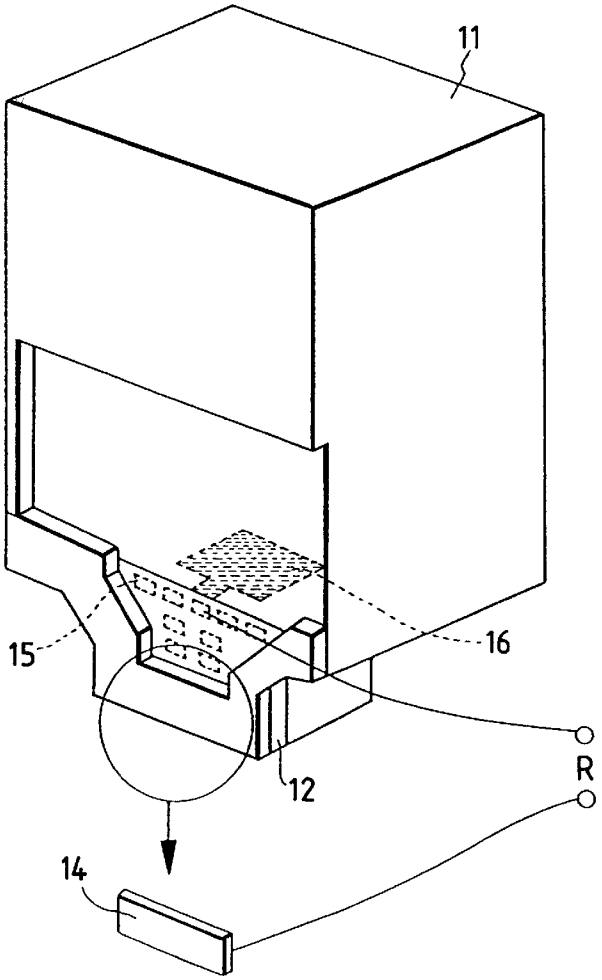
FIG. 8 is a schematic perspective view showing a recording head unit as a third example according to the present invention.

Additionally, FIG. 8 shows an ink remain detecting device as another example of the present invention. In FIG. 8, 11 is an ink tank for holding the ink inside, 12 is a recording head for discharging recording liquid droplets, and 14 is a heater board formed with a plurality of heaters (heat generating elements), and having an electrically conductive film formed on a surface tangential with the ink, in the same manner as shown in FIG. 5 and described in the previous example.

16 is a filter for the removal of contaminants, which is provided in an ink supply passageway between the ink tank 11 and the recording head 12, this filter being formed of an electrically conductive material such as SUS.

Figure 9:
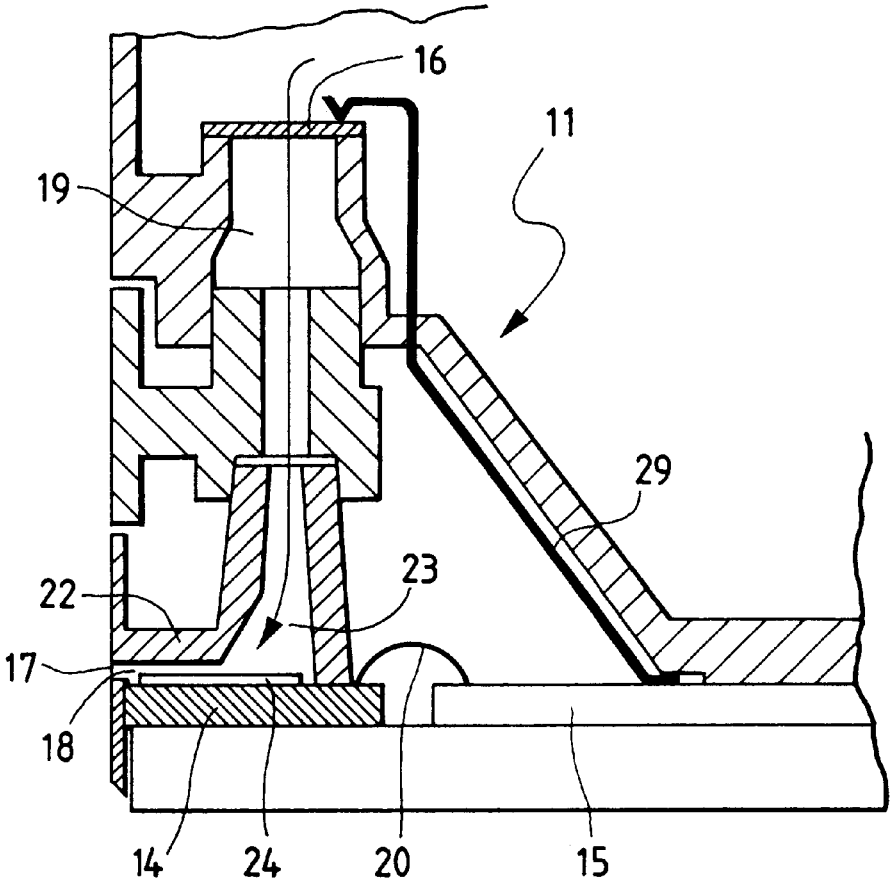
FIG. 9 is an enlarged cross-sectional view of the recording head unit as shown in FIG. 8.

And FIG. 9 is an enlarged cross-sectional view of a portion of the recording head 12 in this example. In this example, unlike the previous example, the electrically conductive filter and the specific pad on the PWB 15 are electrically connected without providing any pin. Herein, the electrical connection between the filter 16 and the PWB 15 can be made by an electrically conductive member 29.

Also, like the first example, 22 is a ceiling plate for forming a plurality of orifices 17 and ink flow passageways 18 for discharging recording liquid droplets, as well as forming a common liquid chamber 23 commonly in communication with the plurality of ink flow passageways. And an electrode film 24 as the electrically conductive film is formed on the heater board 14, and is connected to a specific pad of the PWB 15 with a wire bonding portion 21.

Accordingly, in this example, the measurement of the electrical resistance via the ink between the electrode film 24 and the filter 16 can be made between the terminals within the PWB 15. Therefore, the easier connection to the recording apparatus side can be effected.

In the above constitution, by measuring the resistance between two pads on the PWB 15, the resistance between the filter 16 and the conductive film on the heater board 14 can be measured, thereby enabling the ink near-end detection or the ink condition abnormal detection to be performed.

It should be noted that the electrically conductive film on the heater board can be substituted by employing an anti-cavitation film formed on the surface tangential with the ink on the plurality of heaters.

And by applying the constitution for the ink remain detection with the filter 16 and the electrically conductive film 24 in this example to the ink jet recording unit for color recording as shown in the second example, an ink remain detecting mechanism which is simpler in constitution can be realized.

As above described, by employing the present invention, the ink remain detection within the ink storage portion can be more accurately effected, and the ink condition abnormal detection within the recording head can be made. And especially in the color recording head unit, the ink undischarge prediction which is at lower cost and additionally more reliable can be effected.

What is claimed is:

1. A recording head for mounting upon an ink jet recording apparatus, said recording head comprising:

a plurality of discharge portions;

a liquid chamber in fluid communication with said discharge portions, said liquid chamber having a wall;

a plurality of energy generating elements respectively disposed in said plurality of discharge portions, said wall forming a substrate on which said plurality of energy generating elements are provided;

an electrically conductive film provided tangentially with the ink on a part of said wall of aid liquid chamber; and an electrical connection for electrically connecting to the ink jet recording apparatus on which said recording head is mounted;

wherein said electrically conductive film is provided on said energy generating elements, and wherein said electrically conductive film and said electrical connection are connected to measure the resistance between said electrically conductive film and an electrode located within an ink storage portion which supplies an ink to said liquid chamber.

2. A recording head for mounting upon an ink jet recording apparatus, said recording head comprising:

a plurality of discharge portions;

a liquid chamber in communication with said discharge portions, said liquid chamber having a wall;

an electrically conductive film provided tangentially with the ink on a part of said wall of said liquid chamber; and an electrical connection for electrically connecting to the ink jet recording apparatus on which said recording head is mounted;

wherein said electrically conductive film and said electrical connection are connected to measure the resistance between said electrically conductive film and an electrode located within an ink storage portion which supplies an ink to said liquid chamber; and wherein said electrode is a conductive filter disposed at an end of an ink flow passageway provided on a side of the recording head for conducting the ink within said ink storage portion into said recording head.

3. A recording head according to claim 2, wherein said filter is connected to said electrical connection.

4. An ink jet recording apparatus comprising:

a recording head for mounting upon said ink jet recording apparatus, said recording head comprising:

a plurality of discharge portions;

a liquid chamber in communication with said discharge portions, said liquid chamber having a wall;

an electrically conductive film provided tangentially with the ink on a part of said wall of said liquid chamber; and an electrical connection, connectable to said ink jet recording apparatus, for receiving a signal causing recording;

an ink storage portion for storing the ink supplied to said recording head, said ink storage portion having an inside and comprising an electrode extending into the inside of said ink storage portion; and means for measuring a resistance between said electrode and said electrically conductive film.

5. An ink jet recording apparatus according to claim 4, wherein said recording head further comprises a plurality of energy generating elements respectively disposed in said discharge portions, and wherein said wall is a substrate provided with said energy generating elements.

6. An ink jet recording apparatus according to claim 5, wherein said electrically conductive film is provided on said energy generating elements.

7. An ink jet recording apparatus according to claim 4, wherein said electrode is an electrically conductive filter disposed at an end of an ink flow passageway provided on a side of the recording head for conducting the ink within said ink storage portion into said recording head.

8. An ink jet recording apparatus according to claim 7, wherein said filter is connected to one of said electrical connections.

9. An ink jet recording apparatus according to claim 4, further comprising:

a carriage which can mount thereon said recording head and said ink storage portion; and conveying means for conveying a recording medium onto which said inks are discharged by said recording apparatus.

10. A recording head according to claim 4, further comprising supply means connectable to said ink storing portion for receiving ink from the ink storing portion and for supplying the received ink to said liquid chamber.

11. An ink tank for containing an ink to be supplied to an ink jet recording head having discharge portions for discharging the ink, liquid chambers in communication with said discharge portions, and an electrically conductive film provided on a part of a wall constituting said liquid chambers, said film being in contact with the ink, said ink tank comprising:

an ink storage portion containing said ink; and an electrode exposed into the inside of said ink storage portion;

wherein said electrode is provided to measure a resistance between said electrode and said electrically conductive film.

12. A recording head according to claim 11, further comprising supply means connectable to said ink tank for receiving ink from the ink tank and for supplying the received ink to said liquid chambers.

13. A recording head unit mountable upon an ink jet recording apparatus, said recording head unit comprising:

a plurality of discharge portions;

a liquid chamber in communication with said discharge portions, said liquid chamber having a wall;

an electrically conductive film provided tangentially with the ink on a part of said wall of said liquid chamber;

an electrical connection electrically connecting to the ink jet recording apparatus on which said recording head unit is mounted; and an ink tank, said ink tank having an ink storage portion with an electrode, said ink storage portion for supplying an ink to said liquid chamber, wherein said electrically conductive film and said electrical connection are connected to measure the resistance between said electrically conductive film and said electrode.

* * * * *